US010047737B2

(12) United States Patent
Meza

(10) Patent No.: US 10,047,737 B2
(45) Date of Patent: Aug. 14, 2018

(54) PUMP HEAD COUPLING WITH TWIST-LOCK CONNECTIONS

(71) Applicant: Flow Control LLC, Beverly, MA (US)

(72) Inventor: Humberto V. Meza, Trabuco Canyon, CA (US)

(73) Assignee: Flow Control LLC, Beverly, MA (US)

( * ) Notice: Subject to any disclaimer, the term of this patent is extended or adjusted under 35 U.S.C. 154(b) by 123 days.

(21) Appl. No.: 14/794,284

(22) Filed: Jul. 8, 2015

(65) Prior Publication Data

US 2016/0025086 A1 Jan. 28, 2016

Related U.S. Application Data

(60) Provisional application No. 62/021,755, filed on Jul. 8, 2014.

(51) Int. Cl.
*F04B 39/14* (2006.01)
*F04B 43/04* (2006.01)
(Continued)

(52) U.S. Cl.
CPC ..... *F04B 39/14* (2013.01); *F04B 17/03* (2013.01); *F04B 35/04* (2013.01); *F04B 39/121* (2013.01);
(Continued)

(58) Field of Classification Search
USPC ..... 403/362
See application file for complete search history.

(56) References Cited

U.S. PATENT DOCUMENTS 3,837,767 A 9/1974 Aller
4,049,364 A 9/1977 Ross et al.
(Continued)

FOREIGN PATENT DOCUMENTS

CN 103080557 A 5/2013
CN 103807181 A 5/2014
(Continued)

OTHER PUBLICATIONS

"Standard Submersible Petroleum Pump—U.S.A.," www.twincrown.com, Dec. 18, 2010 https://web.archive.org/web/20101218061345/http://twincrown.com/pump.html.
(Continued)

*Primary Examiner* — Kenneth J Hansen
(74) *Attorney, Agent, or Firm* — Ware, Fressola, Maguire & Barber LLP

(57) ABSTRACT

A pump features: A motor having a front end bell (FEB) with a coupling portion having twist lock style (TLS) connections with locking portions, and an outer surface with a detent; and a pump head (PH) including a PH portion having a PH coupling portion with corresponding TLS connections and corresponding locking portions with locking stops. The PH portion has an outer surface having a threaded orifice. The TLS connections couple together when the FEB and PH coupling portions are pushed together. The locking portions engage when the FEB and PH coupling portions twist together about the longitudinal axis of the pump. The locking stops abut against the locking portions to stop the FEB and PH coupling portions from twisting further, so the detent and the threaded orifice align to receive the LP, locking the motor and PH together.

13 Claims, 5 Drawing Sheets

(51) Int. Cl.

| | |
|---|---|
| ***F04B 53/22*** | (2006.01) |
| ***F04B 17/03*** | (2006.01) |
| ***F04B 35/04*** | (2006.01) |
| ***F04B 39/12*** | (2006.01) |
| ***F04B 43/02*** | (2006.01) |
| ***F04B 53/16*** | (2006.01) |

(52) U.S. Cl.

CPC ..... *F04B 43/02* (2013.01); *F04B 43/04* (2013.01); *F04B 53/16* (2013.01); *F04B 53/22* (2013.01)

(56) References Cited

U.S. PATENT DOCUMENTS

| | | | |
|---|---|---|---|
| 4,336,473 | A | 6/1982 | Wetters et al. |
| 4,477,231 | A | 10/1984 | Swift |
| 4,780,953 | A | 11/1988 | Wheeler et al. |
| 4,998,035 | A | 3/1991 | Jensen |
| 5,021,048 | A | 6/1991 | Buckholtz |
| 5,269,664 | A | 12/1993 | Buse |
| 5,326,235 | A | 7/1994 | Bruhn |
| 6,196,813 | B1 | 3/2001 | Turley et al. |
| 6,471,494 | B1 | 10/2002 | Miura et al. |
| 7,179,066 | B2 | 2/2007 | Good et al. |
| 7,284,965 | B2 | 10/2007 | Adahan |
| 7,847,457 | B2 | 12/2010 | Achor |
| 8,015,912 | B2 | 9/2011 | Stimpson et al. |
| 8,427,020 | B2 | 4/2013 | Hoffman et al. |
| 8,708,672 | B2 | 4/2014 | Marks et al. |
| 8,708,674 | B2 | 4/2014 | Hoffman |
| 8,721,306 | B2 | 5/2014 | Anderson et al. |
| 8,734,133 | B2 | 5/2014 | Tanahashi et al. |
| 2003/0099548 | A1* | 5/2003 | Meza ..... F04B 43/0054 417/44.1 |
| 2003/0202882 | A1* | 10/2003 | Tang ..... F04D 25/088 416/246 |
| 2013/0180495 | A1 | 7/2013 | Veerathappa et al. |
| 2014/0127060 | A1* | 5/2014 | Richter ..... F04D 29/528 417/423.14 |
| 2014/0205478 | A1 | 7/2014 | Guitari et al. |
| 2014/0234141 | A1 | 8/2014 | Hoshi et al. |
| 2015/0110652 | A1 | 4/2015 | Hoshi et al. |

FOREIGN PATENT DOCUMENTS

| | | | | |
|---|---|---|---|---|
| DE | 102010038872 | A1 | 2/2012 | |
| EP | 2674624 | | 12/2013 | |
| EP | 2674624 | A1 * | 12/2013 | ..... F04D 13/02 |
| GB | 2378734 | A | 2/2003 | |
| WO | 2004111464 | | 12/2004 | |

OTHER PUBLICATIONS

"Power Pro ESP, Instruction Manual" fieldenvironmental.com, Part No. 95312, Apr. 25, 2014 http://www.fieldenvironmental.com/assets/files/Manuals/QED%20Power%20Pro%20Manual-4-14.pdf
Note—No internet wayback available, date taken from cover of manual.
English language Abstract of DE102010038872.
English language Abstract of CN103080557A.
English language Abstract of CN103807181A.

* cited by examiner

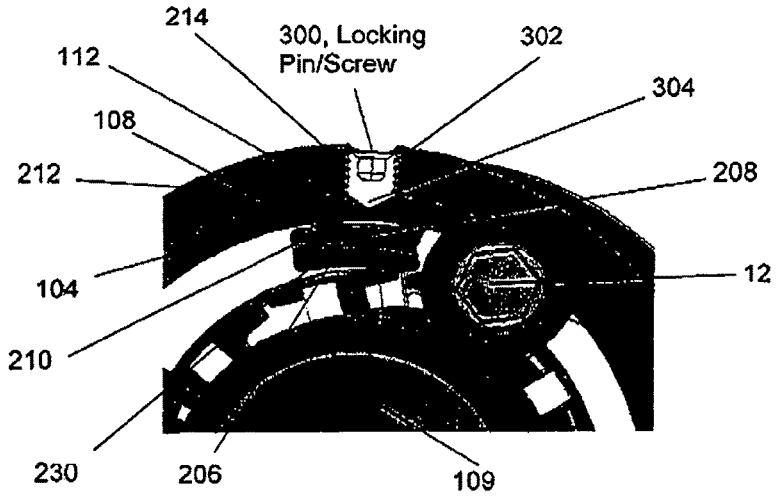
Fig. 6A
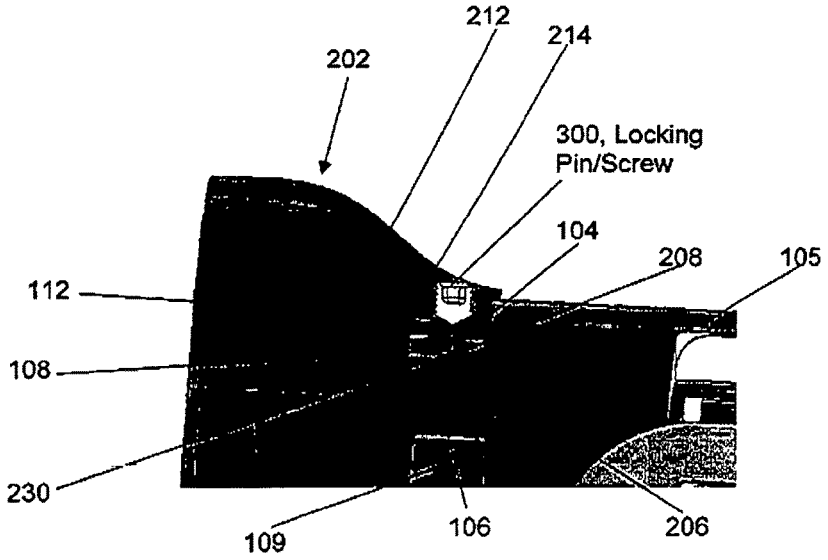
Fig. 6B
Figure 6

PUMP HEAD COUPLING WITH TWIST-LOCK CONNECTIONS

CROSS-REFERENCE TO RELATED APPLICATIONS

This application claims benefit to provisional patent application Ser. No. 62/021,755, filed 8 Jul. 2014, which is hereby incorporated by reference in its entirety.

BACKGROUND OF THE INVENTION

1. Field of the Invention

The present invention relates to a pump; and more particularly relates to a diaphragm pump having a pump head connected to a motor and a technique for connecting the same.

2. Brief Description of Related Art

Currently, pumps have pump heads that are connected to motors using screws or clamps.

Some shortcomings of the known connection technique include:

a. Different motor end bell configurations for each type of pump;
b. Pump heads attached using fasteners have limited port rotation;
c. Rotation of the pump head typically requires a complete disassembly of the pump; and
d. Tools and fixtures are required for assembling the pump head to the motor.

In view of the aforementioned, there is a need in the industry for a pump that solves the shortcomings in the pumps that are known in art.

SUMMARY OF THE INVENTION

According to some embodiments, the present invention may include, or take the form of, a pump featuring a new and unique combination of a motor, a pump head and a locking member. The thrust of the present invention is directed towards how the motor and the pump head are uniquely coupled together.

For example, the motor may include a front end bell with a front end bell coupling portion configured with twist lock style connections with locking portions, and also configured with an outer surface having at least one motor locking receiving portion formed therein, e.g., such as at least one detent.

The pump head may include a pump head portion with a pump head coupling portion configured with corresponding twist lock style connections with corresponding locking portions. Each corresponding locking portion may be configured with a locking stop. The pump head portion may be configured with a corresponding outer surface having a pump head locking receiving portion formed therein, e.g., such as a threaded orifice formed therein.

A locking member may be configured to pass through the pump head locking receiving portion and to engage the at least one motor receiving portion after assembly of the motor and the pump head. The locking member may include, or take the form of, a threaded locking pin.

Each corresponding twist lock style connection of the pump head may be configured to couple to a respective twist lock style connection of the motor when the front end bell coupling portion and the pump head coupling portion are pushed together and rotated along a longitudinal axis of the pump during assembly of the motor and the pump head.

Each locking portion of the front end bell coupling portion may be configured to engage frictionally a respective corresponding locking portion of the pump head coupling portion, when the front end bell coupling portion and the pump head coupling portion are twisted together or rotated in relation to one another about the longitudinal axis of the pump.

Each locking stop of the pump head coupling portion may be configured to abut against a respective locking portion of the front end bell coupling portion to stop the front end bell coupling portion and the pump head coupling portion from twisting together and rotating in relation to one another about the longitudinal axis of the pump, such that the at least one motor locking receiving portion and the pump head locking receiving portion are in alignment to receive the locking member, and also such that the motor and pump head are locked together and cannot be pulled apart along the longitudinal axis of the pump after assembly of the motor and the pump head.

The motor and the pump head are quickly, easily, securely and flexibly coupled together using the aforementioned coupling technique.

The present invention may include one or more of the following features:

The front end bell coupling portion may include a ring-like portion configured about and perpendicular to the longitudinal axis of the pump that has a surface configured with respective grooves, slots or openings. Each groove, slot or opening forms a respective twist lock style connection on the motor.

The pump head coupling portion may include a corresponding ring-like portion configured about and perpendicular to the longitudinal axis of the pump that has a corresponding surface configured with respective tabs. Each tab forms a respective corresponding twist lock style connection on the pump head.

The respective tabs may be configured to couple to the respective grooves, slots or openings when the front end bell coupling portion and the pump head coupling portion are pushed together along the longitudinal axis of the pump during assembly of the motor and the pump head.

The ring-like portion may include a backside surface that has a respective rim around each groove, slot or opening forming a respective locking portion.

Each tab may have a respective base or leg portion extending from the corresponding ring-like surface parallel to the longitudinal axis of the pump and also may have a respective L-shaped flange portion connected to the respective base or leg portion extending perpendicular to the longitudinal axis of the pump, so as to form a respective corresponding locking portion of the pump head.

Each respective L-shaped flange portion of the pump head may be configured to engage frictionally the respective locking portion of the motor when the front end bell coupling portion and the pump head coupling portion are twisted together and rotated in opposite directions about the longitudinal axis of the pump, such that the motor and pump head are locked together and cannot be pulled apart along the longitudinal axis of the pump after assembly of the motor and the pump head.

The locking member may include a locking pin/screw having a threaded bolt portion and an end portion; the at least one motor locking receiving portion may be configured or formed as at least one detent in the outer surface of the motor; the pump head locking receiving portion may be configured or formed as a threaded orifice in the corresponding outer surface of the pump head; and the threaded bolt portion of the locking pin/screw may be configured to be threaded through the threaded orifice and the end portion may be configured to engage the at least one detent in the outer surface of the motor for coupling the motor and the pump head together after assembly.

The at least one detent may include multiple detents that correspond to the number of the respective grooves, slots or openings. Each detent may be configured on the outer surface at a respective circumferential interval that depends on and corresponds with the number of the respective grooves, slots or openings. The circumferential intervals may be equi-spaced. For example, if there are 2 slots/grooves/openings, then there are 2 detents allowing for 180° interchangeable rotation; if there are 3 slots/grooves/openings, then there are 3 detents allowing for 120° interchangeable rotation; if there are 4 slots/grooves/openings, then there are 4 detents allowing for 90° interchangeable rotation; if there are 5 slots/grooves/openings, then there are 5 detents allowing for 72° interchangeable rotation; if there are 6 slots/grooves/openings, then there are 6 detents allowing for 60° interchangeable rotation; etc. This configuration allows for flexible rotational interchangeability that permits the pump head to be rotated depending on the location of the connection to which the pump head's input and output ports need to be connected.

Advantages

The present invention may allow for one or more of the following:

1) The same end bell configuration may be used regardless of pump type.

2) An effective 360° rotation may be allowed in various intervals dependent upon the number of slots/grooves, e.g., 2 slots/grooves/openings allow for 180° intervals, 3 slots/grooves/openings allow for 120° intervals, 4 slots/grooves/openings allow for 90° intervals, 5 slots/grooves/openings allow for 72° intervals, 6 slots/grooves/openings allow for 60° intervals, etc.

3) Changing the orientation of the pump head requires only that the locking pin/screw be loosened, then the pump can be easily rotated to the orientation required.

4) Twist lock style connections allow for ease of assembly of the pump head to the motor. Utilizing the present invention may also allow pump heads to be fully assembled when installed to the motor allowing for stock of pump heads to be stocked complete versus individual components. This may allow for faster production times.

In some embodiments, tabs designed into the pump head may be used to engage the slots/grooves/openings in the motor's end bell.

In effect, the pump using the aforementioned coupling technique according to the present invention solves problems that have plagued the prior art pump, and provides an important contribution to the state of the art.

BRIEF DESCRIPTION OF THE DRAWING

The drawing, which are not necessarily drawn to scale, includes the following Figures:

FIG. 6 includes FIGS. 6A and 6B, where FIG. 6A is a partial cross-section view perpendicular to the longitudinal axis of the pump when assembled in FIG. 1 and showing the grooves of the pump head in FIG. 3 coupled together with the tabs of the motor in FIG. 4 using the rotational twist lock connection, and having a locking pin/screw combination to prevent rotational decoupling; and where FIG. 6B is a partial cross-section view perpendicular to the longitudinal axis of the pump when assembled in FIG. 1 and showing the grooves of the pump head in FIG. 3 coupled together with the tabs of the motor in FIG. 4 using the rotational twist lock connection, and having the locking pin/screw combination to prevent rotational decoupling, according to some embodiments of the present invention.

FIG. 7A shows a motor having a front end bell with connections or tabs; and where FIG. 7B shows a pump head that includes a pump head coupling portion having connections or grooves with locking portions.

DETAILED DESCRIPTION OF THE INVENTION

FIGS. 1-6: Diaphragm Pump

FIGS. 1-6 show a pump 10 having a combination of a motor 100, a pump head 200 and a locking pin 300 (FIG. 6). The thrust of the present invention is how the motor 100 and the pump head 200 are uniquely coupled together, e.g., so as to be locked together both rotationally and axially along the longitudinal axis A.

Figure 1:
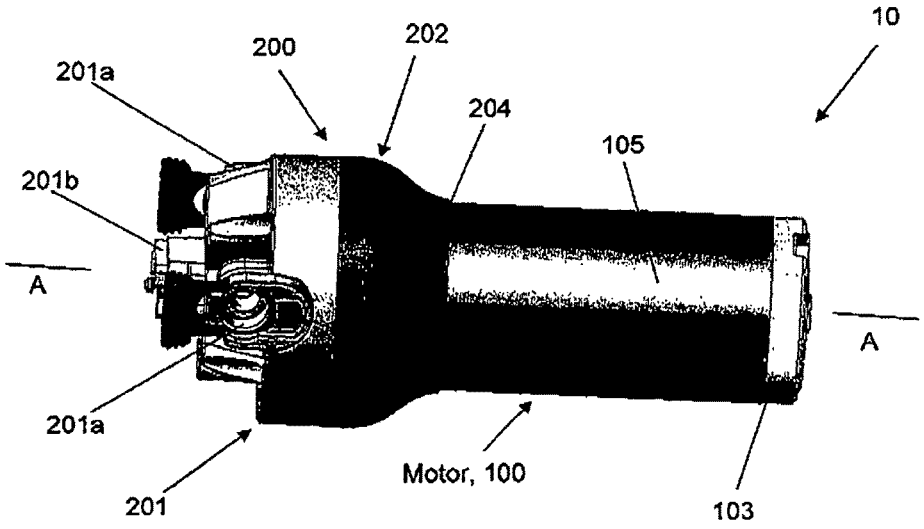
FIG. 1 shows a side view of a pump that is assembled, according to some embodiments of the present invention.
Figure 2:
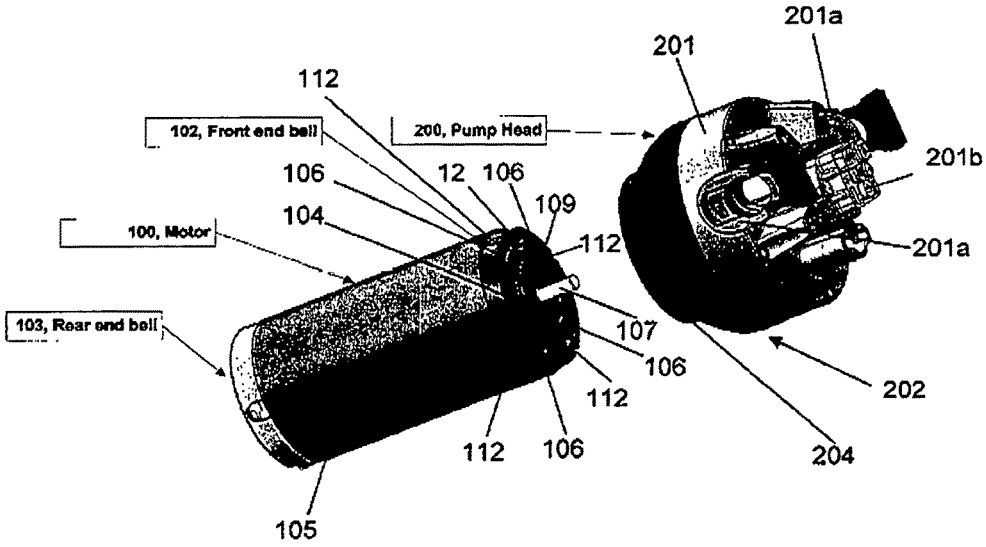
FIG. 2 is a perspective exploded view of the pump in FIG. 1 showing a pump head and a motor before assembly, according to some embodiments of the present invention.
Figure 3:
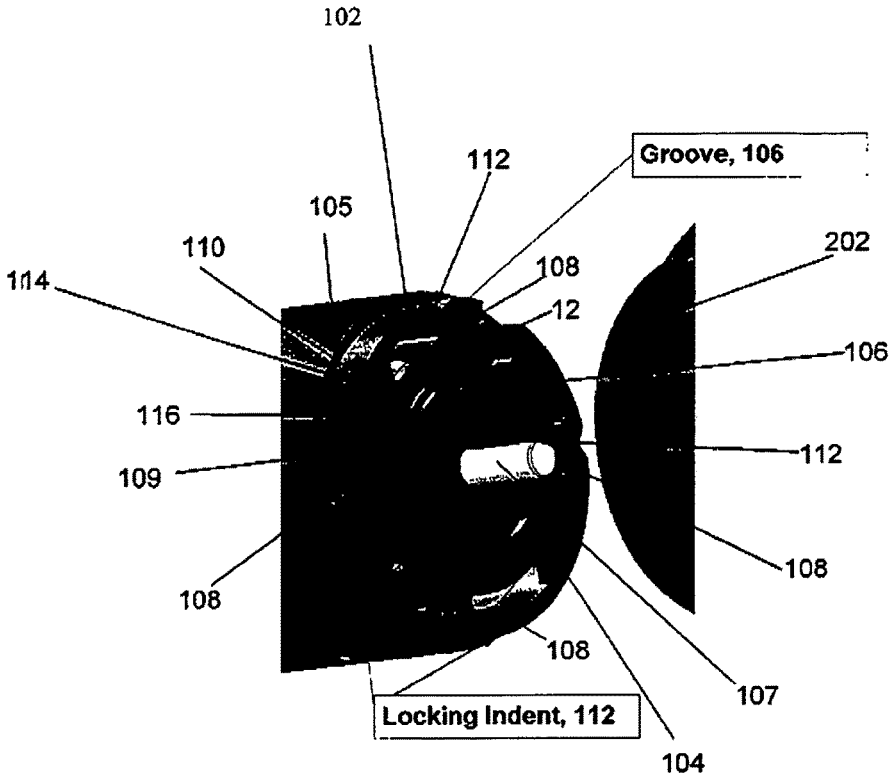
FIG. 3 is a partial perspective exploded view of the pump in FIG. 2 showing the motor having grooves and a locking indent, according to some embodiments of the present invention.

For example, the motor 100 may include a front end bell 102 with a front end bell coupling portion 104 configured with twist lock style connections or grooves 106 with locking portions 108 (see FIG. 3), and also configured with an outer surface 110 with at least one locking intent or detent 112. In FIGS. 2 and 3, the front end bell coupling portion 104 is shown with four twist lock style connections 106, although the scope of the invention is not intended to be limited to any specific number of the same. For example, embodiments of the present invention are envisioned using 2 or 3 twist lock style connections 106, as well as using 5 or 6 twist lock style connections 106, depending on the particular pump application. In FIGS. 2 and 3, the front end bell coupling portion 104 is shown with four locking intents or detents 112, although the scope of the invention is not intended to be limited to any specific number of the same. For example, embodiments of the present invention are envisioned using 2 or 3 locking intent or detent 112, as well as using 5 or 6 locking intent or detent 112, depending on the particular pump application. The number of twist lock style connections 106 and locking intents or detents 112 may depend on, or corresponds with, each other, e.g., so as to allow for flexible rotational interchangeability that permits the pump head 200 to be rotated depending on the location of the connections to which the pump head's input and output ports and/or hose connections 201*a* (FIG. 1) need to be connected.

The locking portion 108 of each twist lock style connections 106 may be configured to be slightly narrower in dimension on one side, and each twist lock style connection 106 may be configured to be at least slightly wider in dimension than the locking portion 109 on its other side, e.g., consistent with that shown in FIGS. 2 and 3, and that described below. The motor 100 may also include a rear end bell 103 and an intermediate housing portion 105 arranged between the front end bell 102 and the rear end bell 103, as well as a motor shaft 107 and covering member 109, all as shown in FIG. 2.

Figure 4:
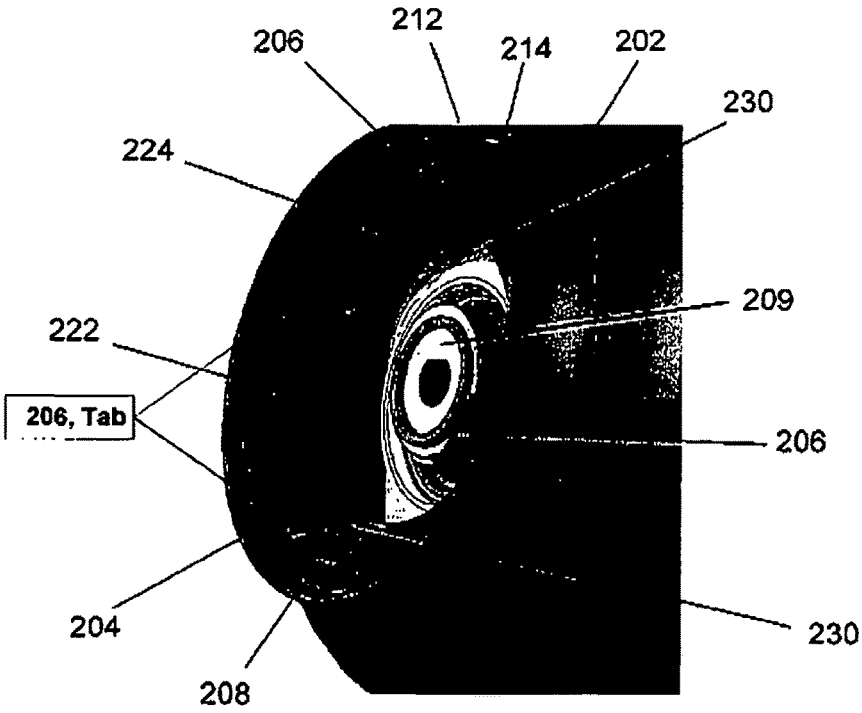
FIG. 4 is a perspective view of the pump head in FIG. 2 showing tabs for coupling with the groove in FIG. 3 when assembled, according to some embodiments of the present invention.
Figure 5:
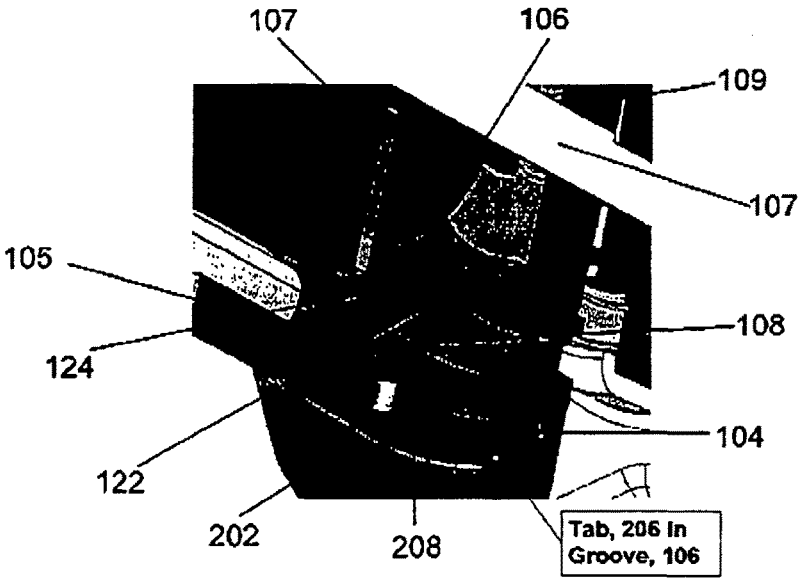
FIG. 5 is a partial cross-sectional view of the pump when assembled in FIG. 1 showing the grooves of the pump head in FIG. 3 coupled together with the tabs of the motor in FIG. 4 using a rotational twist lock connection, according to some embodiments of the present invention.
Figure 7B:
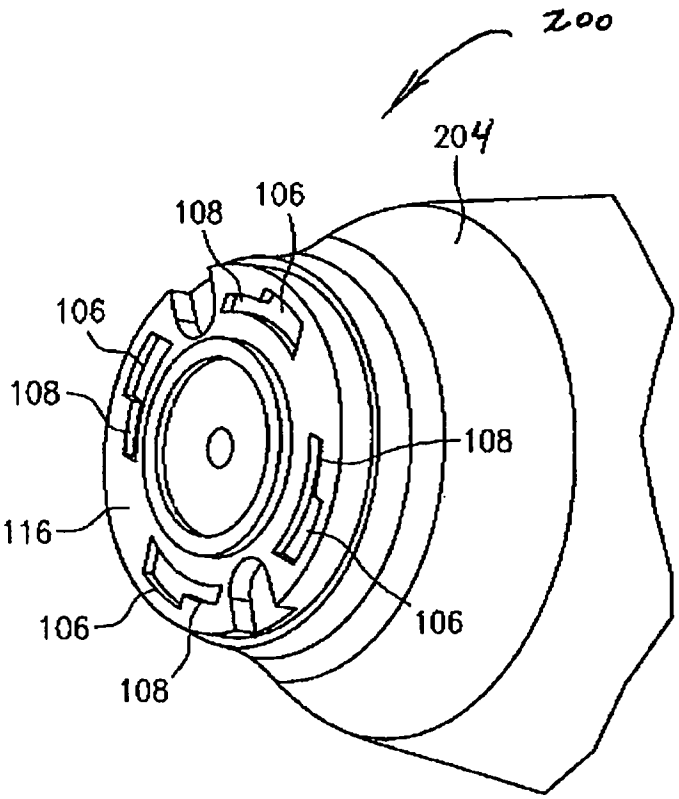
FIGS. 7A and 7B shows an alternative embodiment, where
Figure 7A:
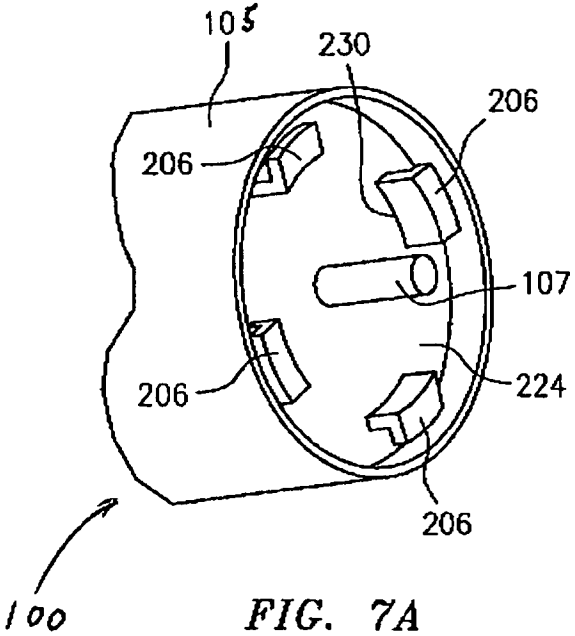

The pump head 200 may include a pump head portion 202 having a pump head coupling portion 204 configured with corresponding twist lock style connections or tabs 206 with corresponding locking portions 208 (see FIGS. 4-5). Each corresponding locking portion 208 may be configured with and L-shape and have a respective locking stop 210, e.g., as shown in FIG. 6A, for stopping the rotation of the pump head 200 in relation to the motor 100 when the assembled together. The pump head portion 202 may be configured with an outer surface 212 having a threaded orifice 214. The pump head 200 may also include a pump head connector and pressure sensing portion 201 (see FIG. 1), e.g., configured with the input/output ports and/or hose connections 201*a* and a pressure sensor module 201*b*, e.g., that do not form part of the underlying invention and are not described in detail. The pump head 200 may also include a motor shaft coupling member 209 configured to couple to the motor shaft 107 when the motor 100 and pump head 200 are assembled together, e.g., allowing the motor 100 to drive the pump head 200 for pumping fluid.

The locking pin 300 may include a threaded portion 302 and an end portion 304. The threaded portion 302 may be configured to thread into the threaded orifice 214, and the end portion 304 may be configured to engage one of the four locking intents or detent 112 after assembly of the motor 100 and the pump head 200.

Each corresponding twist lock style connection 206 may be configured to couple to a respective twist lock style connection 106 when the front end bell coupling portion 104, and the pump head coupling portion 204 may be pushed together along a longitudinal axis A of the pump 10 during assembly of the motor 100 and the pump head 200.

Each locking portion 108 may be configured to engage frictionally a respective corresponding locking portion 208 when the front end bell coupling portion 104 and the pump head coupling portion 204 are twisted together or rotated in relation to one another about the longitudinal axis A of the pump 10.

Each locking stop 210 (see FIG. 6A) may be configured to abut against a respective locking portion 108 to stop the front end bell coupling portion 104 and the pump head coupling portion 204 from twisting together and rotating in relation to one another about the longitudinal axis A of the pump 10, such that one of the four locking intents or detents 112 and the threaded orifice 214 are in alignment to receive the locking pin 300, and also such that the motor 100 and pump head 200 are locked together and cannot be pulled apart along the longitudinal axis A of the pump 10 after assembly of the motor 100 and the pump head 200. In operation, the motor 100 and the pump head 200 are uniquely coupled together, so as to be locked together both rotationally and axially.

The front end bell coupling portion 104 may include a ring-like flat portion 114 configured about and on a plane perpendicular to the longitudinal axis A of the pump 10 that has a surface 116 configured with respective grooves, slots or openings 108, where each groove, slot or opening 108 forms a respective twist lock style connection. The pump head coupling portion 204 may have a corresponding ring-like flat portion 222 configured about and on a corresponding plane perpendicular to the longitudinal axis A of the pump 10 that has a corresponding surface 224 configured with respective twist lock style connections or tabs 206, where each tab 206 forms a respective corresponding twist lock style connection. The respective locking portions 208 of the respective tabs 206 may be configured to pass through the wider portion of the respective grooves, slots or openings 108, and the respective locking portions 208 of the respective tabs 206 may also be configured to engage the narrowed locking portion 108 and couple to a respective rim 124 (see FIG. 5) of the respective grooves, slots or openings 108 when the front end bell coupling portion 104 and the pump head coupling portion 204 are pushed together along the longitudinal axis A of the pump 10 and rotated during assembly of the motor 100 and the pump head 200, e.g., consistent with that shown in FIGS. 5 and 6.

The ring-like portion 114 may include a backside surface 122 (see FIG. 5) that is configured with the respective rim 124 around each groove, slot or opening 118 forming a respective locking portion. Each tab 206 may have a respective base or leg portion 230 (see FIG. 4) extending from the corresponding ring-like surface 224 parallel to the longitudinal axis A of the pump 10 and also may have the respective L-shaped flange or locking portion 208 (see FIG. 4) connected to the respective base or leg portion 230 extending perpendicular to the longitudinal axis A of the pump 10, so as to form each respective corresponding locking portion 208 of the pump head 200. Each respective L-shaped flange or locking portion 208 of the pump head 200 may be configured or dimensioned to be passed through the wider portion of the respective groove, slot or opening 108, to be rotated within the respective groove, slot or opening 106 from the wider portion to the narrower portion of the respective locking portion 108, and to be engaged frictionally with the respective locking portion 108 of the motor 100, when the front end bell coupling portion 104 and the pump head coupling portion 204 are twisted together and rotated in opposite directions about the longitudinal axis A of the pump 10, such that the motor 100 and pump head 200 are locked together and cannot be pulled apart along the longitudinal axis A of the pump 10 after assembly of the motor 100 and the pump head 200. FIG. 6B shows the tab 206 rotated into the narrower portion of the groove 106, such that the locking portion 208 of the tab 206 cannot axially pull out of the narrower locking portion 108 of the groove 106, e.g., by being pulled in the leftward direction along the longitudinal axis A as shown.

As a person skilled in the art would appreciate, the pump 10 disclosed herein may also include other elements or components that do not form part of the underlying invention, e.g., including one or more nuts like element 12 for coupling the front end bell 102 to part of the motor 100, e.g., including the motor housing 105.

The Combination of the Locking Pin 300 and Detent 112

By way of example, the present invention is disclosed using a combination of a locking pin and detent for implementing a rotational locking and coupling technique between the motor 100 and pump head 200 when assembled. However, the scope of the invention is not intended to be limited to any particular rotational locking and coupling technique. For example, embodiments are envisioned, and the scope of the invention is intended to include, using other types or kinds of rotational locking and coupling techniques that are now known or later developed in the future, including a key and keyway combination where a key is inserted into a keyway, turned (e.g., 90, 180 or 360 degrees) and locked in place, for rotationally locking and coupling the motor 100 and pump head 200 together when assembled.

The Twist Lock Style Connections or Tabs 206

By way of example, the present invention is disclosed using twist lock style connections 206, which take the form of an L-shape tab. However, the scope of the invention is not intended to be limited to any particular or kind of twist lock style connections. For example, embodiments are envisioned, and the scope of the invention is intended to include, using other types or kinds of twist lock style connections that are now known or later developed in the future, including twist lock style connections that takes the form of pins, each having a respective stem and a respective head arranged on one end for coupling into a respective twist lock style connection or groove 106 for rotationally locking and axially coupling the motor 100 and pump head 200 together when assembled, e.g., such that the head that would correspond to the locking portion 208 of the tab 206 cannot axially pull out of the narrower locking portion 108 of the groove 106.

Possible Applications

By way of example, possible applications may include using the present invention in any pump and motor combination, including a diaphragm pump.

The Scope of the Invention

Further still, the embodiments shown and described in detail herein are provided by way of example only; and the scope of the invention is not intended to be limited to the particular configurations, dimensionalities, and/or design details of these parts or elements included herein. In other words, a person skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What I claim is:

1. A pump comprising:

a motor having a front end bell with a front end bell coupling portion configured with front end bell twist lock connections with front end bell locking portions, and configured with a front end bell outer surface with at least one motor locking receiving portion formed therein;

a pump head having a pump head portion with a pump head coupling portion configured with pump head twist lock connections with pump head locking portions, each pump head locking portion configured with a respective pump head locking stop, the pump head portion configured with a pump head outer surface having a pump head locking receiving portion formed therein; and a locking member configured to pass through the pump head locking receiving portion and to engage the at least one motor receiving portion after assembly of the motor and the pump head;

each pump head twist lock connection configured to couple to a respective front end bell twist lock connection of the front end bell twist lock connections, when the front end bell coupling portion and the pump head coupling portion are pushed together and rotated along a longitudinal axis of the pump during assembly of the motor and the pump head;

each pump head locking portion configured to engage frictionally a respective front end bell locking portion of the front end bell locking portions, when the front end bell coupling portion and the pump head coupling portion are twisted together or rotated in relation to one another about the longitudinal axis of the pump;

each pump head locking stop configured to abut against the respective front end bell locking portion to stop the front end bell coupling portion and the pump head coupling portion from twisting together and rotating in relation to one another about the longitudinal axis of the pump, such that the at least one motor locking receiving portion and the pump head locking receiving portion are in alignment to receive the locking member, and such that the motor and pump head are locked together and cannot be pulled apart along the longitudinal axis of the pump after assembly of the motor and the pump head;

the front end bell coupling portion having a front end bell ring-like portion configured about and perpendicular to the longitudinal axis of the pump, and the front end bell ring-like portion having a front end bell surface configured with a respective plurality of grooves, each groove forming a respective front end bell twist lock connection;

the pump head coupling portion has a pump head ring-like portion configured about and perpendicular to the longitudinal axis of the pump, and the pump head ring-like portion has a pump head surface configured with a respective plurality of tabs, each tab forming the respective pump head twist lock connection; and the respective plurality of tabs configured to couple to the respective plurality of grooves when the front end bell coupling portion and the pump head coupling portion are pushed together along the longitudinal axis of the pump during assembly of the motor and the pump head.

2. A pump according to claim 1, wherein the front end bell ring-like portion has a backside surface, the backside surface having a respective rim around each groove forming the respective front end bell locking portion;

each tab has a respective base portion extending from the pump head ring-like surface parallel to the longitudinal axis of the pump and also has a pump head L-shaped flange portion connected to the respective base portion extending perpendicular to the longitudinal axis of the pump, so as to form a respective pump head locking portion of the pump head locking portions; and each pump head L-shaped flange portion is configured to engage frictionally the respective front end bell locking portion when the front end bell coupling portion and the pump head coupling portion are twisted together and rotated in opposite directions about the longitudinal axis of the pump.

3. A pump according to claim 1, wherein the locking member comprises a locking pin/screw having a threaded bolt portion and an end portion;

the at least one motor locking receiving portion is configured as at least one detent in the front end bell outer surface of the motor;

the pump head locking receiving portion is configured as a threaded orifice in the corresponding outer surface of the pump head; and the threaded bolt portion of the locking pin/screw is configured to be threaded through the threaded orifice and the end portion is configured to engage the at least one detent in the outer surface of the motor for coupling the motor and the pump head together after assembly.

4. A pump according to claim 3, wherein the at least one detent includes multiple detents that corresponds to the respective plurality of grooves; and each detent is configured on the front end bell outer surface at a respective circumferential interval that depends on and corresponds with the respective plurality of grooves.

5. A pump according to claim 1, wherein the pump is a diaphragm pump.

6. A pump comprising:

a motor having a front end bell with a front end bell coupling portion configured with front end bell twist lock connections with front end bell locking portions, and configured with a front end bell outer surface with at least one motor locking receiving portion formed therein;

a pump head having a pump head portion with a pump head coupling portion configured with pump head twist lock connections with pump head locking portions, each pump head locking portion configured with a respective pump head locking stop, the pump head portion configured with a pump head outer surface having a pump head locking receiving portion formed therein;

a locking member configured to pass through the pump head locking receiving portion and to engage the at least one motor receiving portion after assembly of the motor and the pump head;

each pump head twist lock connection configured to couple to a respective front end bell twist lock connection of the front end bell twist lock connections, when the front end bell coupling portion and the pump head coupling portion are pushed together and rotated along a longitudinal axis of the pump during assembly of the motor and the pump head;

each pump head locking portion configured to engage frictionally a respective front end bell locking portion of the front end bell locking portions, when the front end bell coupling portion and the pump head coupling portion are twisted together or rotated in relation to one another about the longitudinal axis of the pump;

each pump head locking stop configured to abut against the respective front end bell locking portion to stop the front end bell coupling portion and the pump head coupling portion from twisting together and rotating in relation to one another about the longitudinal axis of the pump, such that the at least one motor locking receiving portion and the pump head locking receiving portion are in alignment to receive the locking member, and such that the motor and pump head are locked together and cannot be pulled apart along the longitudinal axis of the pump after assembly of the motor and the pump head;

the front end bell coupling portion having a front end bell ring-like portion configured about and perpendicular to the longitudinal axis of the pump, and the front end bell ring-like portion having a front end bell surface configured with a respective plurality of tabs, each tab forming a respective front end bell twist lock connection;

the pump head coupling portion has a pump head ring-like portion configured about and perpendicular to the longitudinal axis of the pump, and the pump head ring-like surface having a pump head surface configured with a respective plurality of grooves, each groove forming the respective pump head twist lock connection; and the respective plurality of tabs configured to couple to the respective plurality of grooves when the front end bell coupling portion and the pump head coupling portion are pushed together along the longitudinal axis of the pump during assembly of the motor and the pump head.

7. A pump according to claim 6, wherein each tab has a respective base portion extending from the front end bell ring-like surface parallel to the longitudinal axis of the pump and also has a respective front end bell L-shaped flange portion connected to the respective base portion extending perpendicular to the longitudinal axis of the pump, so as to form a respective pump head locking portion of the pump head locking portions;

the pump head ring-like portion has a backside surface, the backside surface having a respective rim around each groove forming the respective pump head locking portion; and each front end bell L-shaped flange portion of the motor configured to engage frictionally the respective pump head locking portion of the pump head when the front end bell coupling portion and the pump head coupling portion are twisted together and rotated in opposite directions about the longitudinal axis of the pump.

8. A pump comprising:

a motor having a front end bell with a front end bell coupling portion configured with front end bell twist lock connections with front end bell locking portions, and configured with a front end bell outer surface having at least one detent formed therein;

a pump head having a pump head portion with a pump head coupling portion configured with pump head twist lock connections with pump head locking portions, each pump head locking portion configured with a respective pump head locking stop, the pump head portion configured with a pump head outer surface having a threaded orifice;

a locking pin having a threaded portion and an end portion, the locking pin configured to thread into the threaded orifice and the end portion is configured to engage the at least one detent after assembly of the motor and the pump head;

each pump head twist lock connection configured to couple to a respective front end bell twist lock connection of the front end bell twist lock connections, when the front end bell coupling portion and the pump head coupling portion are pushed together and rotated along a longitudinal axis of the pump during assembly of the motor and the pump head;

each pump head locking portion configured to engage frictionally a respective front end bell locking portion of the front end bell locking portions, when the front end bell coupling portion and the pump head coupling portion are twisted together or rotated in relation to one another about the longitudinal axis of the pump;

each pump head locking stop configured to abut against the respective front end bell locking portion to stop the front end bell coupling portion and the pump head coupling portion from twisting together and rotating in relation to one another about the longitudinal axis of the pump, such that the at least one detent and the threaded orifice are in alignment to receive the locking pin, and such that the motor and pump head are locked together and cannot be pulled apart along the longitudinal axis of the pump after assembly of the motor and the pump head;

the front end bell coupling portion having a front end bell ring-like portion configured about and perpendicular to the longitudinal axis of the pump, and the front end bell ring-like portion having a front end bell surface configured with a respective plurality of grooves, each groove forming a respective front end bell twist lock connection;

the pump head coupling portion having a pump head ring-like portion configured about and perpendicular to the longitudinal axis of the pump, and the pump head ring-like portion having a pump head surface configured with a respective plurality of tabs, each tab forming a respective pump head twist lock connection; and the respective plurality of tabs configured to couple to the respective plurality of grooves when the front end bell coupling portion and the pump head coupling portion are pushed together along the longitudinal axis of the pump during assembly of the motor and the pump head.

9. A pump according to claim 8, wherein the front end bell ring-like portion has a backside surface, the backside surface having a respective rim around each groove forming the respective front end bell locking portion;

each tab has a respective base portion extending from the pump head surface parallel to the longitudinal axis of the pump and also has a respective pump head L-shaped flange portion connected to the respective base portion extending perpendicular to the longitudinal axis of the pump, so as to form a respective pump head locking portion; and each respective pump head L-shaped flange portion is configured to engage frictionally the respective front end bell locking portion of the motor when the front end bell coupling portion and the pump head coupling portion are twisted together and rotated in opposite directions about the longitudinal axis of the pump.

10. A pump according to claim 8, wherein the at least one detent includes multiple detents that corresponds to the respective plurality of grooves; and each detent being configured on the outer surface at a respective circumferential interval that depends on and corresponds with the respective plurality of grooves.

11. A pump according to claim 8, wherein the pump is a diaphragm pump.

12. A pump comprising:

a motor having a front end bell with a front end bell coupling portion configured with front end bell twist lock connections with front end bell locking portions, and configured with a front end bell outer surface having at least one detent formed therein;

a pump head having a pump head portion with a pump head coupling portion configured with pump head twist lock connections with pump head locking portions, each pump head locking portion configured with a respective pump head locking stop, the pump head portion configured with a pump head outer surface having a threaded orifice; and a locking pin having a threaded portion and an end portion, the locking pin configured to thread into the threaded orifice and the end portion is configured to engage the at least one detent after assembly of the motor and the pump head;

each pump head twist lock connection configured to couple to a respective front end bell twist lock connection of the front end bell twist lock connections, when the front end bell coupling portion and the pump head coupling portion are pushed together and rotated along a longitudinal axis of the pump during assembly of the motor and the pump head;

each front end bell locking portion configured to engage frictionally a respective pump head locking portion of the pump head locking portions, when the front end bell coupling portion and the pump head coupling portion are twisted together or rotated in relation to one another about the longitudinal axis of the pump;

each front end bell locking stop configured to abut against a respective front end bell locking portion of the front end bell locking portions to stop the front end bell coupling portion and the pump head coupling portion from twisting together and rotating in relation to one another about the longitudinal axis of the pump, such that the at least one detent and the threaded orifice are in alignment to receive the locking pin, and such that the motor and pump head are locked together and cannot be pulled apart along the longitudinal axis of the pump after assembly of the motor and the pump head;

the front end bell coupling portion having a front end bell ring-like portion configured about and perpendicular to the longitudinal axis of the pump, and the front end bell ring-like portion having a front end bell surface configured with a respective plurality of tabs, each tab forming the respective front end bell twist lock connection;

the pump head coupling portion having a pump head ring-like portion configured about and perpendicular to the longitudinal axis of the pump, and the pump head ring-like surface has a pump head surface configured with a respective plurality of grooves, each groove forming a respective pump head twist lock connection; and the respective plurality of tabs configured to couple to the respective plurality of grooves when the front end bell coupling portion and the pump head coupling portion are pushed together along the longitudinal axis of the pump during assembly of the motor and the pump head.

13. A pump according to claim 12, wherein each tab has a respective base portion extending from the front end bell ring-like surface parallel to the longitudinal axis of the pump and also has a respective front end bell L-shaped flange portion connected to the respective base portion extending perpendicular to the longitudinal axis of the pump, so as to form the respective front end bell locking portion;

the pump head ring-like portion has a backside surface, the backside surface having a respective rim around each groove forming the respective pump head locking portion; and each respective front end bell L-shaped flange portion of the motor configured to engage frictionally the respective pump head locking portion when the front end bell coupling portion and the pump head coupling portion are twisted together and rotated in opposite directions about the longitudinal axis of the pump.

* * * * *